United States Patent [19]

Stroffolino

[11] Patent Number: 4,509,420

[45] Date of Patent: Apr. 9, 1985

[54] UMBRELLA SILK SCREENING FIXTURE

[75] Inventor: Leon C. Stroffolino, Oceanport, N.J.

[73] Assignee: Vito J. Paolantonio, Oceanport, N.J.

[21] Appl. No.: 539,662

[22] Filed: Oct. 6, 1983

[51] Int. Cl.[3] ..... B41F 17/00

[52] U.S. Cl. ..... 101/35; 101/126

[58] Field of Search ..... 101/35, 126, 407 R, 101/407 BP; 248/177, 178, 454

[56] References Cited

U.S. PATENT DOCUMENTS

| | | | |
|---|---|---|---|
| 1,131,802 | 3/1915 | Stenshoel | 248/178 X |
| 4,073,232 | 2/1978 | Brewer | 101/126 |
| 4,084,504 | 4/1978 | Fuchs | 101/126 X |
| 4,266,476 | 5/1981 | Maloof | 101/35 |

FOREIGN PATENT DOCUMENTS

| | | | |
|---|---|---|---|
| 1410933 | 10/1968 | Fed. Rep. of Germany | 101/35 |

*Primary Examiner*—Clifford D. Crowder

*Attorney, Agent, or Firm*—Robert M. Skolnik

[57] ABSTRACT

A silk screening fixture for umbrellas to enable limited quantities of umbrellas to be silk screened in local shops. The fixture is adjustable in height for umbrellas of different length handles, in width, for umbrellas of different diameter, and in angle, for umbrellas of differing curvature. Two legs and a lateral arm are shown with one of the legs carrying a support plate for the silk screen which plate is adjustable in angle. The distance between the legs adjusts for the diameter of the umbrella, while a series of differing length collars are provided on the other leg to adjust for handle length.

3 Claims, 5 Drawing Figures

UMBRELLA SILK SCREENING FIXTURE

BACKGROUND OF THE INVENTION

1. Field of the Invention

This invention relates to a fixture for assisting in the silk screening of designs, logos etc. on umbrellas.

2. Prior Art

Silk screening of custom designs on T-shirts, jackets etc., has become widespread in recent years. The present invention enables such silk screening to be done on fully assembled umbrellas without the need to disassemble the umbrella and without the risk of damage to the mechanical parts of the umbrella. While silk screening on umbrellas has been done, such process involves imprinting the design on the umbrella fabric before the fabric is affixed to the remaining parts of the umbrella. This limits the practicality of such silk screening to large volume requirements.

This invention enables silk screening to be done in smaller quantities of umbrellas at local facilities where such business is now extensively conducted instead of at the factory as part of the manufacture of the umbrella. As such manufacture generally takes place in the countries of the Far East, the ability to offer custom silk screened umbrellas locally is limited.

SUMMARY OF THE INVENTION

The invention includes a hollow leg member for supporting the stem or handle of an opened umbrella. The leg is provided with adjustability in height to accomodate umbrellas of different handle sizes. The fabric portion of the opened umbrella is then supported on a plate which is angularly adjustable to accomodate umbrellas of different curvatures therby providing the portion of the fabric to be silk screened with flat stable support. The spread of the arms or the radius of the umbrella is adjusted for by allowing the spacing between the support plate and the handle support to vary.

The principal object of this invention is to provide a fixture which enables the silk screening of fully assembled umbrellas without risk of damage to the umbrella.

Another object of the invention is to enable silk screening of umbrellas to be done economically in limited quantities at the local level.

BRIEF DESCRIPTION OF THE DRAWINGS

These and other features and advantages of the invention will become apparent to those skilled in the art from the following specification and claims appended thereto, and the accompanying drawings in which:

DESCRIPTION OF THE PREFERRED EMBODIMENT

Figure 1:
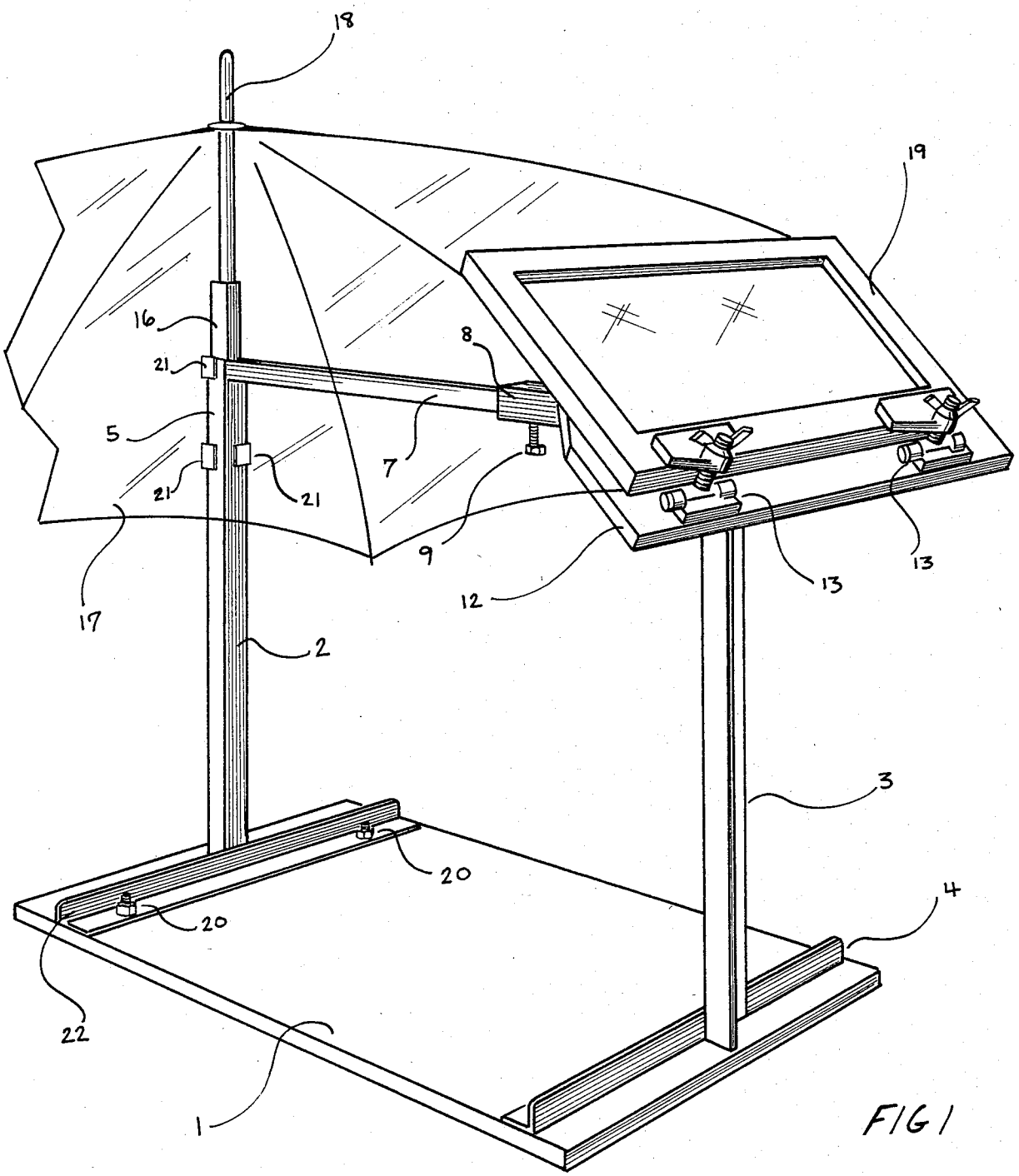
FIG. 1 is a perspective view of the invention.

FIG. 1 shows the invention in perspective view with a clear plastic umbrella 17 mounted in position for silk screening. The fixture has a flat base 1 formed of metal to provide stability. Two legs, 2 and 3 extend upwardly from opposite sides of the base. Leg 2 is fixed on the base via bolts 20 while leg 3 is moveable along the base.

Supports 22 and 4 ensure the stability of legs 2 and 3 respectively.

Umbrella 17 has its handle or stem (not shown) supported in leg 2. The top portion of the handle is shown at numeral 18. Through a series of adjustments which will be described below, the fabric portion of the umbrella to be silk screened is supported on plate 12. The silk screen 19 is clamped over the portion of the umbrella via swing clamps to hold the screen firmly over the umbrella.

Figure 2:
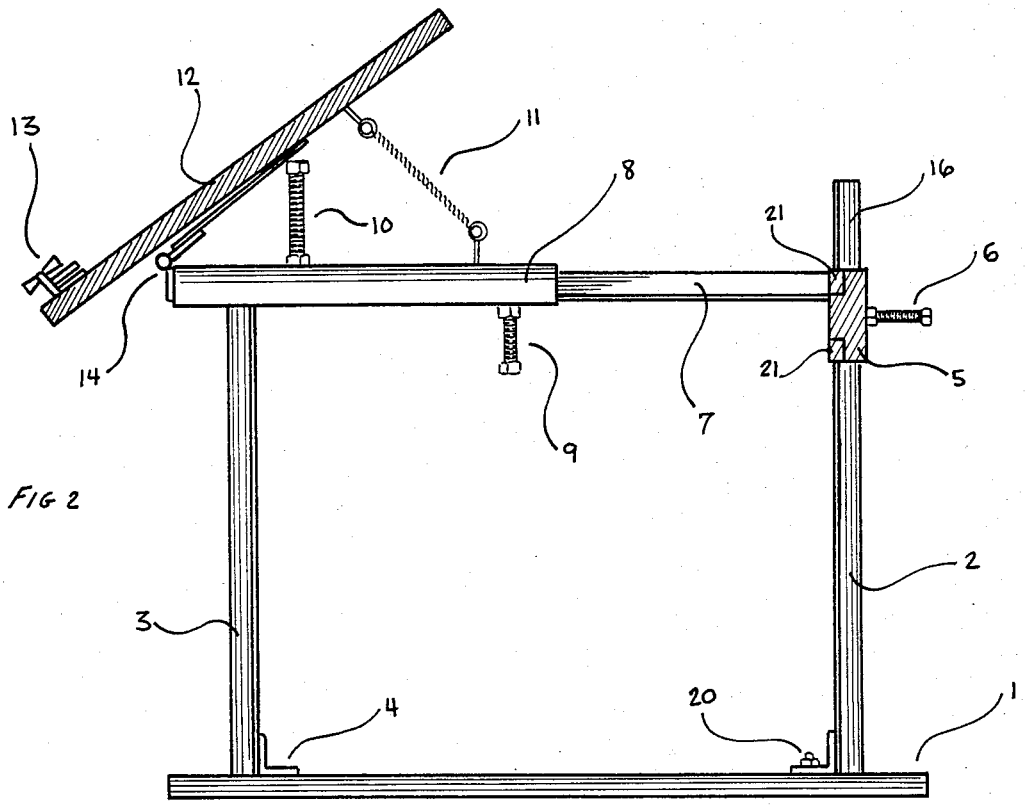
FIG. 2 is a side view of the invention.
Figure 4:
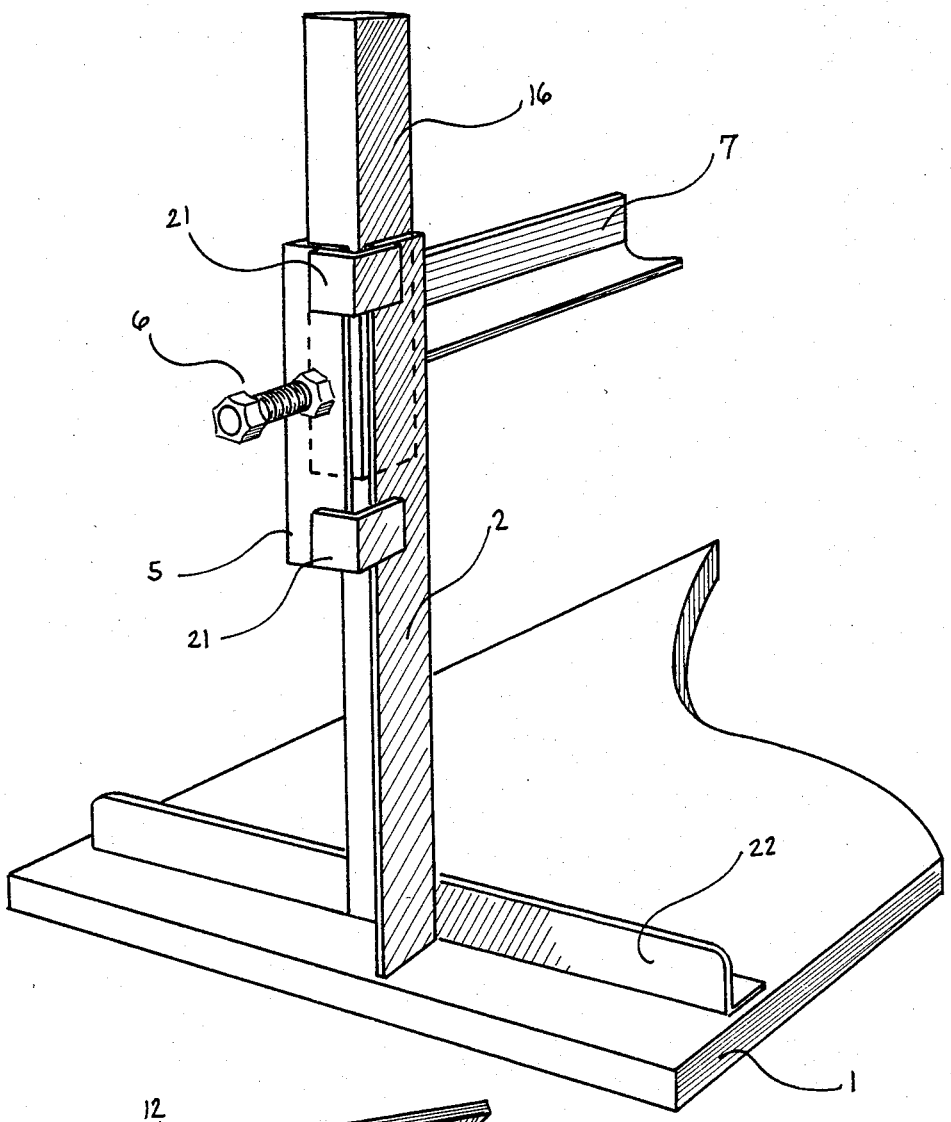
FIG. 4 is a sectional view of a portion of the invention.

In FIGS. 2 and 4, a hollow collar 5 is fixedly mounted on leg 2. The collar 5 is held in place by angle members 21. A lateral arm 7 is affixed to collar 5 which, as can be seen, has another collar 8 slidably mounted for lateral movement along arm 7. This collar is held in position by screw 9 which operates by the tightening of the screw against the portion of arm 7 under the collar. Collar 8 is affixed to one end of leg 3.

Figure 3:
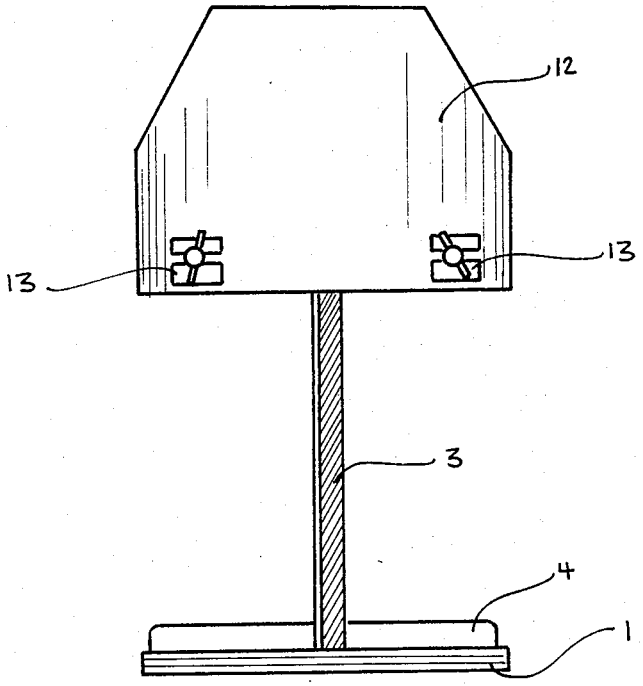
FIG. 3 is an end view of the invention.
Figure 5:
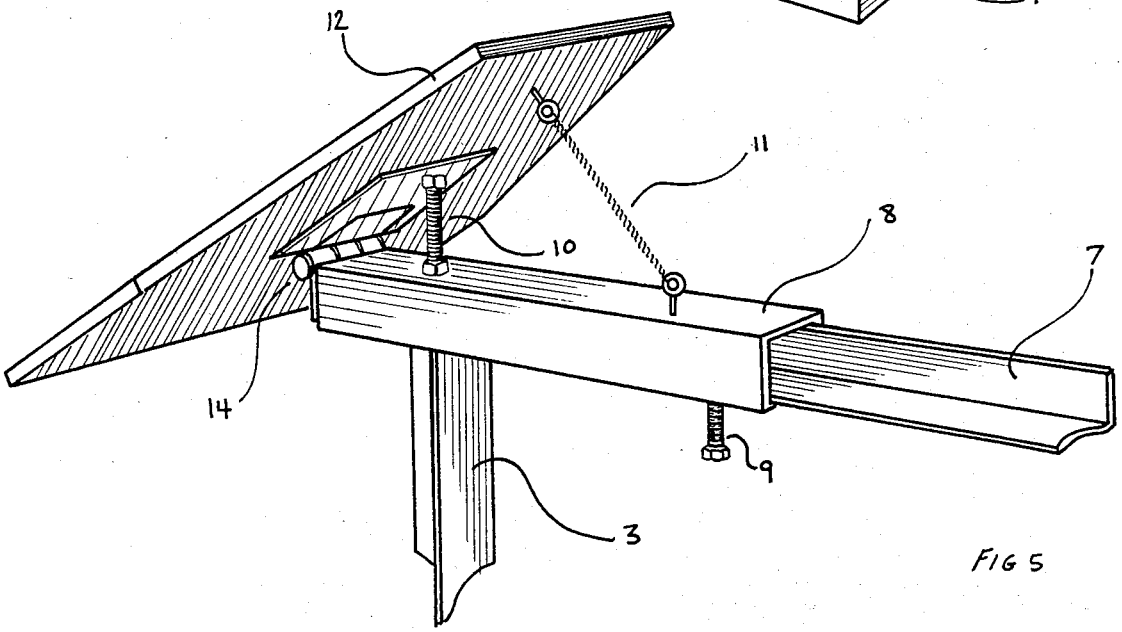
FIG. 5 is a view, partially sectioned, of the adjustable plate support mechanism of the invention.

As shown in FIGS. 2–3 and 5, a supporting trapezoidal plate 12 is also affixed to collar 8 via a hinge 14. The plate 12 provides backing and support and serves as a work surface for the portion of the umbrella 17 to be silk screened. Movement of the plate 12 is limited by screw post 10, also affixed to the collar 8, and by tension spring 11 connected between the plate 12 and collar 8 to hold plate 12 firmly in place.

As shown in FIG. 3, clamps 13 are provided to firmly hold the silk screen and the umbrella material in place on plate 12 during silk screening.

In operation, the umbrella is opened and its handle inserted into leg 2 and collar 5. The portion of the umbrella material to be silk screened is then placed over the plate 12 and clamped under the screen by clamps 13. The spread of the umbrella when opened is adjusted for by moving plate 12 by adjusting the position of collar 8 and leg 3 along arm 7.

As shown in FIG. 4, another collar 16 may be supplied to provide further support and compensation for umbrella handles of different lengths. This collar mounts between the inner wall of collar 5 and the external surface of leg 2 so that screw 6 can tighten against collar 16 thereby holding fast the entire assembly. Collar 16 may be provided in any length or a series of such collars of differing lengths may also be used to provide proper support of umbrella handles of various lengths.

FIG. 5 shows a detailed view of adjusting post 10. As can be seen, post 10 is threadedly engaged into collar 8 and can pass through the collar to adjust its length and thereby, the angle of the plate 12 relative to arm 7 for providing stable support to the umbrella fabric regardless of the curvature of the umbrella.

The various structural members in the drawing have been shown as angle elements but can be hollow tubes or squares as well.

While the invention has been shown and described in detail, it is not to be considered as being limited to the exact form disclosed, and changes in detail and construction may be made therein within the scope of the invention, without departing from the spirit thereof.

What is claimed is:

1. A device for supporting an umbrella to facilitate printing on a portion of the umbrella comprising: a base; first and second legs extending upwardly from said base; said first leg being slidably mounted for lateral movement along said base, and said second leg being affixed to said base; a first collar affixed to said first leg; a second collar affixed to said second leg; an arm affixed to said second collar and slidably mounted in said first collar; said arm extending from said second collar into said first collar generally parallel to said base; and adjustable support means affixed to said first collar for supporting a portion of the umbrella.

2. A fixture for silk screening comprising; a base; first and second support means extending upwardly from said base; said first support means affixed to said base, and said second support means being slidably mounted for movement along said base; adjusting means attached to said first and second support means for adjusting the spacing between said second support means and said first support means along said base; and third support means connected to said adjusting means for supporting the material to be silk screened, said third support means including a plate connected to said second support means; a hinge connected between said plate and said second support means to enable said plate to move relative to said second support means; tension spring means connected between said plate and said second support means to firmly hold said plate; a supporting post formed between said second support means and said plate to hold said plate against the tension of said spring; and clamping means connected to said plate to hold the material to be silk screened.

3. The fixture of claim 2 wherein said first support means is hollow for receiving a portion of the article to be silk screened; and said first support means includes a first collar mounted on said first support means; an arm affixed to said collar extending in a direction parallel to said base towards said second support means; and a second collar slidably mounted about said arm and affixed to said second support means.

* * * * *